US006568138B1

(12) United States Patent
Frost et al.

(10) Patent No.: US 6,568,138 B1
(45) Date of Patent: May 27, 2003

(54) FRAMING SYSTEM AND RELATED FRAMING SECTION ASSEMBLY

(75) Inventors: Gordon James Frost, LaGrange, IN (US); Steven Lee Kilmer, Elkhart, IN (US); John Mack Reed, Mishawaka, IN (US)

(73) Assignee: Exterior Systems, Inc., Toledo, OH (US)

( * ) Notice: Subject to any disclaimer, the term of this patent is extended or adjusted under 35 U.S.C. 154(b) by 0 days.

(21) Appl. No.: 09/568,634

(22) Filed: May 10, 2000

(51) Int. Cl.[7] ..... E04B 2/76
(52) U.S. Cl. ..... 52/241; 52/656.1
(58) Field of Search ..... 52/241, 656.1, 52/690, 696; 29/897.31, 897.312, 897.32

(56) References Cited

U.S. PATENT DOCUMENTS

| | | | | |
|---|---|---|---|---|
| 3,693,293 A | | 9/1972 | Egan, Jr. et al. | |
| 4,193,245 A | * | 3/1980 | Johnson | 52/656.1 |
| 4,602,467 A | | 7/1986 | Schilger | |
| 4,878,323 A | | 11/1989 | Nelson | |
| 4,918,899 A | * | 4/1990 | Karytinos | 52/690 |
| 4,986,052 A | | 1/1991 | Nelon | |
| 5,024,039 A | | 6/1991 | Karhumaki | |
| 5,157,883 A | * | 10/1992 | Meyer | 52/696 |
| 5,222,335 A | | 6/1993 | Petrecca | |
| 5,394,665 A | | 3/1995 | Johnson | |

* cited by examiner

*Primary Examiner*—Michael Safavi
(74) *Attorney, Agent, or Firm*—Inger H. Eckert; James J. Dottavio; Maria C. Gasaway

(57) ABSTRACT

A framing system and related framing section assembly includes at least one first member, preferably in the form of a U-shaped track or channel, that receives at least one second member, such as a stud. The stud is captured on or between spaced protrusions or pairs of protrusions projecting inwardly from the opposed sidewalls of the receiver. The protrusions securely, but releasably, hold the corresponding end of the stud in place in the receiver. To form a framing section assembly using this system, two opposed receivers are provided for engaging and supporting each end of a plurality of studs. To permit variable positioning of the studs in the receivers and enhance flexibility during installation, the protrusions may be equidistantly spaced at frequent intervals. Surface indicia may also be provided on the receivers at certain conventional intervals to allow the installer to easily determine the proper location for the studs.

17 Claims, 8 Drawing Sheets

FRAMING SYSTEM AND RELATED FRAMING SECTION ASSEMBLY

TECHNICAL FIELD

The present invention relates generally to the wall framing art and, more particularly, to an improved system for positioning and securely, but removably, holding studs in place along a receiver, such as a U-shaped channel, track, or the like, to form a framing section.

BACKGROUND OF THE INVENTION

In recent decades, a concern has arisen over the excessive exploitation of natural resources such as timber. One way of conserving such resources is to form framing sections for use in buildings of studs and corresponding channel or track members fabricated of metal. In addition to being competitive with wood in terms of cost, metal also provides the advantage of being relatively stronger per unit of weight, easier to form into various shapes, and less susceptible to damage, such as by fire or insect infestations.

Despite these advantages, providing an easy and efficient manner of constructing a framing section using metal studs and channels on-site has been a problem. Mechanical fasteners such as self-tapping screws or staples were employed in the past, but these have proven difficult and time-consuming to use, which of course increases the installation cost. Another problem with such fasteners is that the installer must precisely determine and mark the locations for positioning the studs on the channels prior to installation.

Others in the past have sought to overcome these shortcomings by providing structures projecting from the sidewalls of each opposed channel or track that automatically engage the corresponding ends of the studs. An example is found in U.S. Pat. No. 5,222,335 to Petrecca, which discloses a framing section formed of a pair of opposed channels, each having opposing rows of spaced, inwardly projecting dimples. Sets of four of the spaced dimples on each channel engage and capture the ends of corresponding studs in a vertical position. However, stability against rotation is a problem, since the single point of contact made with each dimple does not reliably prevent the stud from shifting or rotating.

In an effort to overcome this limitation, U.S. Pat. No. 5,394,665 to Johnson proposes forming arcuate protrusions in the channel sidewalls that nest in correspondingly shaped recesses formed in a stud. While this arrangement seemingly overcomes the primary shortcoming of the Petrecca framing section, other limitations remain. Specifically, in the Johnson framing section, the stud is difficult, if not impossible, to remove once installed, since the sidewalls of the channel must be bent outwardly to release the nested arcuate protrusion from the corresponding recess. When an installer inadvertently installs a stud incorrectly and must change its position, or if the location of a door or window is moved prior to covering the frame with drywall sheeting or the like, this arrangement creates an obviously undesirable situation in terms of both efficiency and cost.

Accordingly, a need is identified for an improved system for forming framing sections using metal members, such as studs and corresponding pairs of receivers in the form of U-shaped tracks or channels.

SUMMARY OF THE INVENTION

The present invention is directed to a framing system and related framing section assembly. The system includes at least one first member, which is preferably a U-shaped track or channel, that receives at least one second member, such as a stud. To eliminate any tendency for rotation or lateral shifting, the stud is captured on or held between one or more protrusions projecting inwardly from the opposed sidewalls of the receiver. Advantageously, these protrusions securely, but releasably, hold the corresponding end of each stud in place in the receiver. Thus, the stud may be easily removed after installation, if necessary, without permanently deforming or otherwise damaging the corresponding portion of the receiver.

To form a framing section assembly using this system, two opposed receivers are provided for engaging and supporting each end of a plurality of studs. To permit variable positioning of the studs in the receivers, a plurality of spaced protrusions or pairs of vertically spaced protrusions are provided in each receiver. The protrusions may be equidistantly spaced at frequent intervals to allow for variable positioning of the studs, which promotes flexibility. Also, one or more distinctive surface indicia may be provided on the receivers at certain conventional spacing intervals allow the installer to easily position each stud. Overall, a much improved framing section assembly is provided using the system of the present invention, especially in terms of cost and ease of installation.

In accordance with a first aspect of the present invention, a framing system is provided and comprises at least one first framing member having at least one first protrusion formed in a first sidewall thereof and at least one second protrusion formed in a second sidewall thereof. Each of the protrusions includes a substantially continuous and unbroken outer surface relative to each of the sidewalls. At least one second framing member includes at least one first aperture formed in a first sidewall. This aperture receives the corresponding first protrusion in a snap-fit engagement, while at least one second aperture formed in a second sidewall of this second framing member receives the second protrusion, also in a snap-fit engagement.

In one embodiment, the at least one first framing member comprises a first substantially U-shaped receiver and the at least one second framing member comprises a stud. The stud includes a first end having the first and second apertures formed therein. This first end corresponds to the first U-shaped receiver, which includes first and second sidewalls. The sidewalls in both the receiver and the stud are opposed.

The framing system further includes a second U-shaped receiver having at least one first protrusion formed in a first sidewall thereof and at least one second protrusion formed in a second sidewall thereof. At least one stud further includes first and second apertures at a second end for receiving the corresponding protrusions in the opposed sidewalls of the second U-shaped receiver in snap-fit engagement.

In one particular embodiment, the second U-shaped receiver includes a first sidewall and an opposed second sidewall. Also, each of the first and second receivers includes a plurality of the first protrusions projecting from each first sidewall thereof and a plurality of the second protrusions projecting from each second sidewall thereof. The protrusions on each sidewall are spaced apart and substantially aligned in a horizontal plane.

To form the framing section in this embodiment, a plurality of the studs are provided for engaging the first and second receivers. Specifically, each stud includes a first end having first and second apertures formed in the opposed sidewalls thereof and a second end, also including first and second apertures formed in the opposed sidewalls thereof. Each aperture in each end of the stud engages a corresponding one of the protrusions in the opposed sidewalls of the first and second U-shaped receivers to form the framing section.

In another embodiment, the framing system also includes a second U-shaped receiver, but this receiver, as well as the first U-shaped receiver, each include a plurality of vertically spaced and aligned pairs of protrusions projecting from each opposed sidewall thereof. To form the framing section in this embodiment of the system, a plurality of the studs are provided. Each stud includes first and second pairs of vertically aligned and spaced apertures formed in the opposed sidewalls at each end thereof. These apertures are sized for receiving the corresponding pairs of protrusions in each of the first and second receivers in a snap-fit engagement.

Each of the protrusions formed in the sidewalls of each of the receivers, whether alone or in vertically spaced and aligned pairs, are preferably spaced apart an equal distance. This distance is preferably selected from the group consisting of 12, 2, 16, and 24 inches, but other distances may be used depending on the particular application, or depending on the size of the studs being used to form the framing section. Also, a first surface indicia is provided on each receiver adjacent to the protrusions on at least one of the sidewalls at each 16 inch interval, and/or a second surface indicia is provided on each receiver adjacent to the protrusions in at least one of the sidewalls at each 24 inch interval. Thus, each indicia advantageously allows the installer to quickly identify the locations for the studs at conventional intervals used in building construction.

Also, to provide a secure snap-fit engagement, but one that is capable of being released, if necessary, each protrusion is preferably hemispherical. Of course, forming the protrusions in other shapes is also possible, as long as the substantially continuous and unbroken outer surface relative to the sidewalls is created. For instance, in one alternate embodiment, the protrusions are rectangular in cross-section, with the apertures in the studs each having a corresponding shape. In either case, the need for mechanical fasteners or the concomitant use of tools is eliminated, but the snap-fit engagement still provides the desired secure connection.

In accordance with a second aspect of the present invention, a framing section assembly is provided. The assembly comprises first and second U-shaped receivers, each having a first pair of aligned, vertically spaced protrusions projecting from a first sidewall thereof and a second pair of aligned, vertically spaced protrusions projecting from a second opposed sidewall thereof. Interposed between the receivers to form the framing section assembly is at least one stud. The stud includes a first end for insertion between the first and second pairs of vertically spaced protrusions of the first receiver and a second end for insertion between the first and second pairs of vertically spaced protrusions in the second receiver. These pairs of protrusions together serve to capture and prevent the stud from rotating relative to the receivers. As with the framing system, the protrusions may be hemispherical or rectangular in cross-section, or other shapes may be employed.

In accordance with a third aspect of the present invention, a framing system is provided including a first framing member having at least one first protrusion formed in a first sidewall thereof and at least one second protrusion formed in a second sidewall thereof. At least one second framing member is provided having at least one first recess formed in a first sidewall thereof for receiving the corresponding first protrusion in a snap-fit engagement and at least one second shaped recess formed in a second sidewall thereof for receiving the second protrusion also in a snap-fit engagement. Each of the recesses includes a substantially continuous and unbroken outer surface relative to the corresponding sidewall.

In one embodiment, the first framing member comprises a U-shaped receiver and the at least one second framing member comprises a stud. The first and second recesses are formed at a first end of the stud corresponding to the first U-shaped receiver. To form a framing section, a second U-shaped receiver is provided having a protrusion formed in each opposed sidewall thereof These protrusions engage a second pair of corresponding recesses at a second end of the stud.

In another embodiment, each of the receivers includes a plurality of vertically aligned and spaced pairs of protrusions projecting from each opposed sidewall thereof. A plurality of the studs are also provided, each including first and second pairs of correspondingly shaped recesses formed in each end thereof. The recess are adapted for receiving one of the corresponding pairs of protrusions in the receivers in a snap-fit engagement to form a framing section.

DETAILED DESCRIPTION OF THE INVENTION

Figure 1:
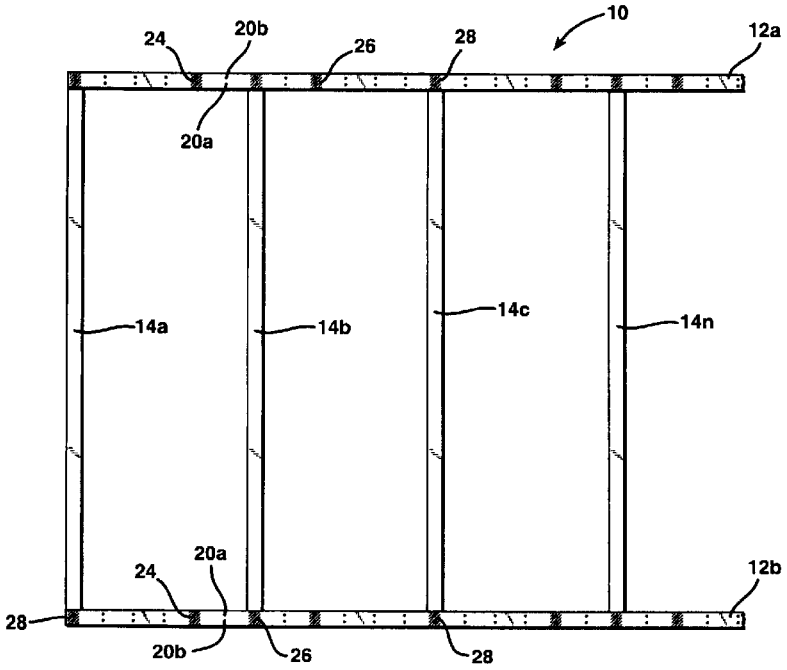
FIG. 1 is a side elevational view of one embodiment of a framing section assembly.

Reference is now made to FIG. 1, which illustrates a framing section 10 or framing section assembly constructed according to one possible embodiment of the framing system of the present invention. In this particular embodiment, the framing section 10 includes a pair of opposed receivers 12*a*, 12*b* interconnected by a plurality of elongated studs 14*a* . . . 14*n*. Preferably, both the receivers 12*a*, 12*b* and the studs 14*a* . . . 14*n* are C or U-shaped in cross-section. Accordingly, each receiver 12*a*, 12*b*, includes first and second opposed sidewalls 16*a*, 16*b* interconnected by a base wall or web 16*c*. Similarly, each stud 14*a* . . . 14*n* includes first and second opposed sidewalls 18*a*, 18*b* and a third transverse wall or web 18*c* connecting the two together. To enhance structural rigidity, and for other reasons that will be evident upon reviewing the description that follows, the opposed sidewall 18*a*, 18*b* of each stud 14*a* . . . 14*n* preferably includes an inwardly projecting lip or flange 18*d*, 18*e*. However, these flanges 18*d*, 18*e* may be omitted, if desired, or alternatively a continuous front wall (not shown) may be provided similar to wall 18*c* for interconnecting the sidewalls 18*a*, 18*b*, thus creating a tubular, substantially square or rectangular cross-section.

As specifically illustrated in FIGS. 2–5, each receiver sidewall 16*a*, 16*b* in this first embodiment includes at least one, and preferably a plurality of pairs of vertically spaced, inwardly projecting protrusions 20*a*, 20*b*. These protrusions 20*a*, 20*b* are preferably hemispherical in shape and include a substantially continuous and unbroken outer surface relative to the respective sidewalls 16*a*, 16*b* (see FIG. 5). At least a first end of each stud 14*a* . . . 14*n* is provided with a corresponding pair of openings or apertures 22*a*, 22*b*. These apertures 22*a*, 22*b* are positioned for receiving the protrusions 20*a*, 20*b* in snap-fit engagement when the corresponding terminal end of the stud 14*a* . . . 14*n* is seated against the base wall 16*c* of each respective receiver 12*a*, 12*b*. Thus, as shown in the exploded view of FIG. 4, by aligning and manually forcing this first end of the stud 14*n* into the corresponding receiver 12*b* until it is seated therein (see action arrow A), the desired snap-fit engagement is achieved between the protrusions 20*a*, 20*b* and the corresponding apertures 22*a*, 22*b*. As a result of this engagement, a secure, but releasable connection is established between the stud 14*n* and the corresponding receiver 12*b* without the need for mechanical fasteners or tools. Alternatively, the stud 14*n* may be rotated 90E prior to insertion between the sidewalls 16*a*, 16*b* of the receiver 12*b*, and then rotated either clockwise or counterclockwise into place such that the protrusions 20*a*, 20*b* engage the corresponding apertures 22*a*, 22*b* from the side to create the desired snap-fit engagement. In either case, the sidewalls 16*a*, 16*b* flex outwardly just enough to allow the protrusions 20*a*, 20*b* to pass into the respective apertures 22*a*, 22*b*, and then immediately snap back to the substantially vertical position once these protrusions are engaged and the stud 14*n* is in the operative position.

Advantageously, by providing substantially continuous and unbroken protrusions 20*a*, 20*b*, edges created by "broken" or discontinuous protrusions jutting from the sidewalls which may prevent easy release of a captured stud are avoided. This ensures that the stud 14*n* may be removed from the corresponding receiver 12*b* by simply lifting it upwardly or rotating it side-to-side to overcome the detent-like force resulting from the snap-fit engagement. Thus, if the installer inadvertently places a stud 14*a* . . . 14*n* at an incorrect location, or if the architect, construction supervisor or designer decides to move the location of a wall opening, such as a door or window, during construction, any the corresponding studs 14*a* . . . 14*n* can simply be moved to another location, or simply removed altogether. Despite this releasability, the snap-fit engagement also provides the desired resistance against rotation, especially in the horizontal plane.

As noted above and shown in FIG. 1, the second receiver 12*a* also forms a part of the framing section 10 and is preferably in the form of a C or U-shaped channel (not shown). Its plurality of vertically aligned and spaced pairs of protrusions 20*c*, 20*b* receive the apertures (not shown) formed in the opposite or second end of each of the plurality of studs 14*a* . . . 14*n* in snap fit engagement. In a conventional building construction, the second, or upper, receiver 12*a* is attached to a ceiling joist or other roof truss member, while the first, lower receiver 12*b* is connected to the flooring or other members opposing the ceiling joists. To form the framing section 10 when the receivers 12*a*, 12*b* are pre-installed in this manner, the studs 14*a* . . . 14*n* may simply be inserted at the desired intervals where the pairs of protrusions 20*a*, 20*b* are provided. However, preforming the studs 14*a* . . . 14*n* and opposed receivers 12*a*, 12*b* into a framing section 10 prior to installation is of course also possible.

Figure 2:
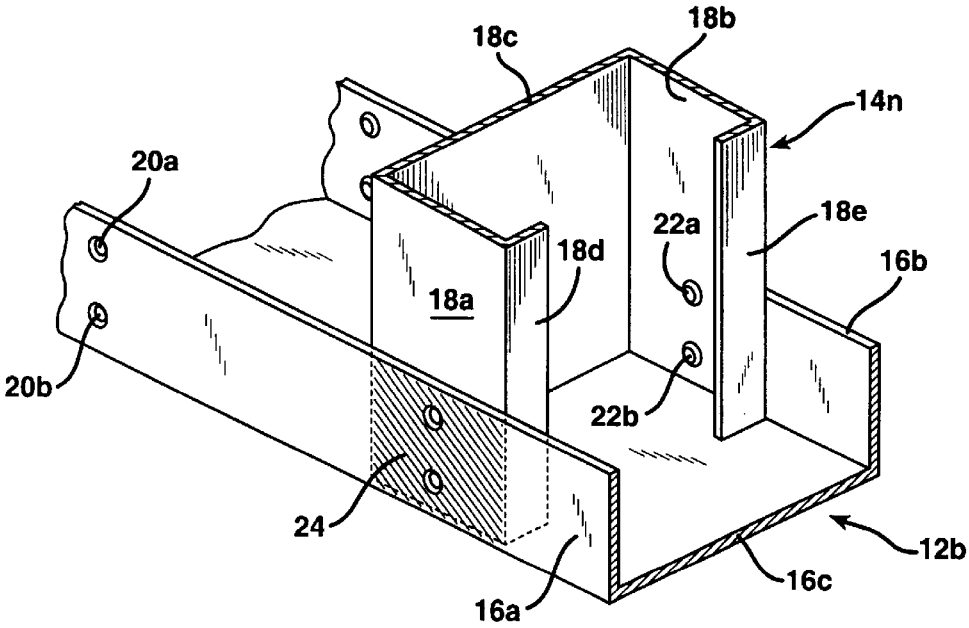
FIG. 2 is an enlarged, partially cutaway perspective view of a first end of a single stud having a pair of vertically aligned and spaced apertures formed in each sidewall thereof, each pair of apertures engaging corresponding pairs of protrusions formed in each opposed sidewall of a first U-shaped receiver.
Figure 3:
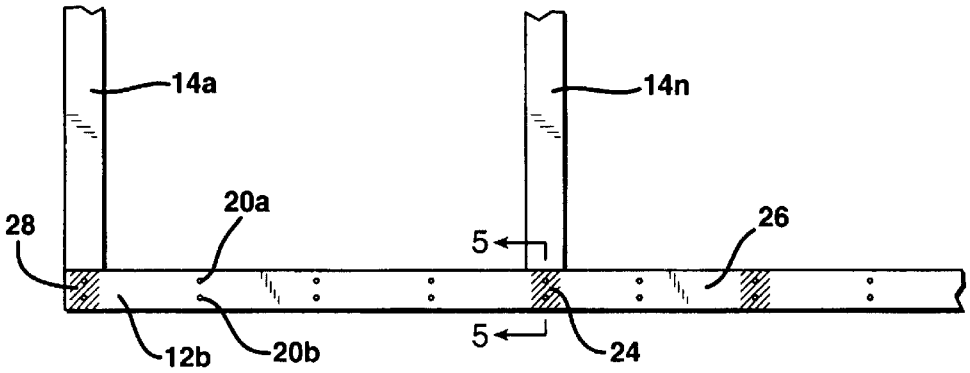
FIG. 3 is an enlarged, partially cutaway side elevational view of the embodiment shown in FIG. 1 showing the various surface indicia on the receiver for marking particular spacing intervals.
Figure 4:
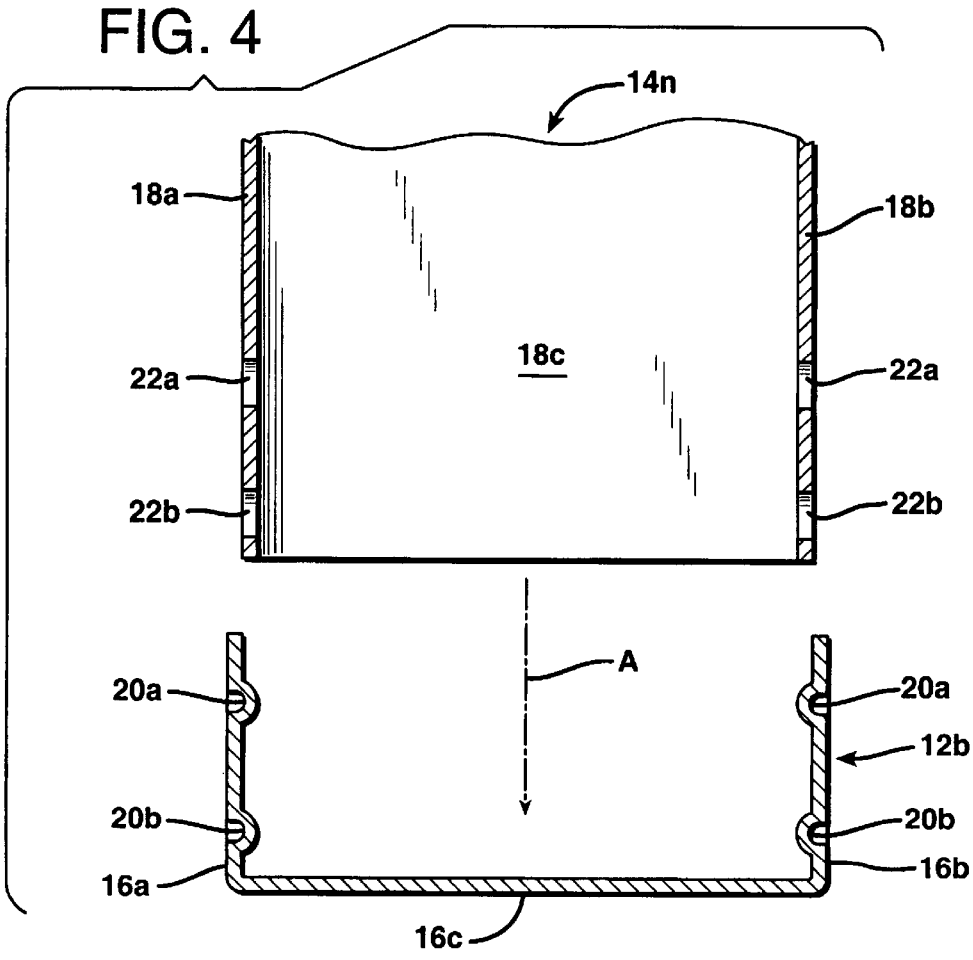
FIG. 4 is an exploded, cross-sectional view of the manner in which one end of the stud may be inserted in the corresponding receiver.
Figure 5:
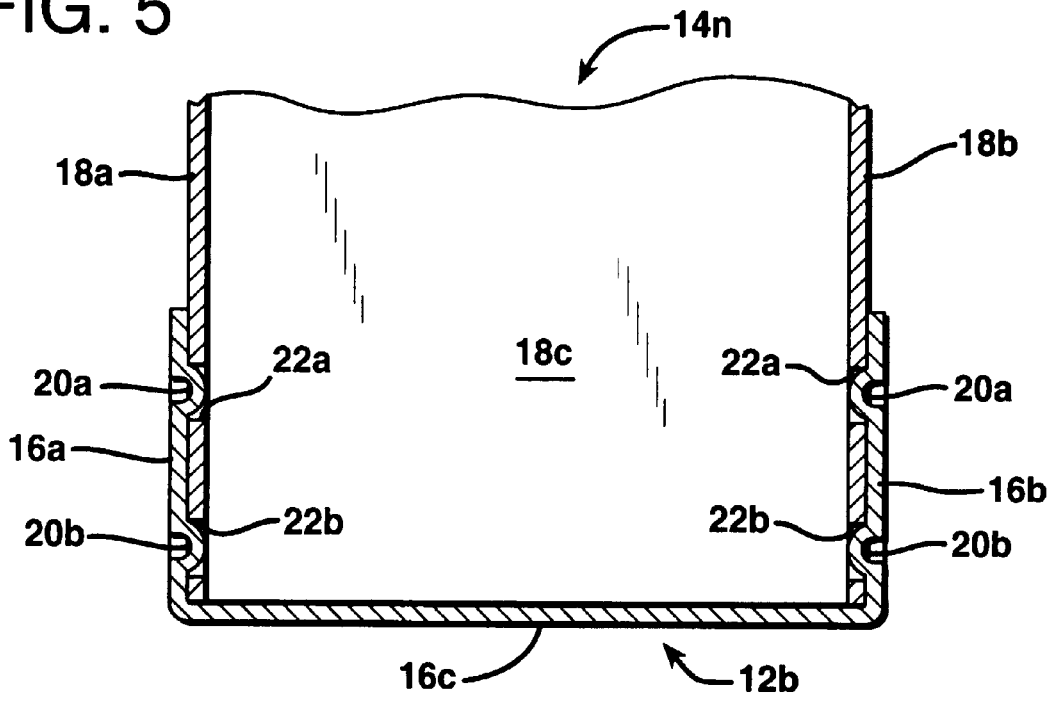
FIG. 5 is a cross-sectional view taken along line 5—5 in FIG. 3 of the opposed protrusions in the U-shaped receiver in snap-fit engagement with the corresponding apertures at one end of the stud.

As shown in FIGS. 1–3, the pairs of protrusions 20*a*, 20*b* are preferably provided at equally spaced intervals along each respective sidewall 16*a*, 16*b* of the receivers 12*a*, 12*b*. Preferably, this spacing interval is relatively short, such as 12 or 2 inches. As should be appreciated, this short, equidistant spacing allows for the positioning of the studs 14*a* . . . 14*n* at a variety of selected locations. For instance, pairs of adjacent studs, such as studs 14*a* and 14*b* in FIG. 1, may be placed at certain selected conventional intervals, such as on 16 or 24 inch centers, or at non-conventional locations, as may be necessary for framing windows, doors, or other portals. This short, equidistant spacing also allows the studs 14*a* . . . 14*n* to be placed immediately next to each other in a juxtaposed relationship, as may be necessary at locations where enhanced structural support is necessary. Instead of this incremental close spacing, the interval may simply be provided in other increments commonly used in building construction, such as at 16 or 24 inches, or both. Of course, when the 2 inch intervals are employed, a pair of the protrusions 20*a*, 20*b* invariably fall at both the conventional 16 and 24 inch spacing intervals.

In accordance with one of the many important aspects of the present invention, and as best shown in FIGS. 2 and 3, each receiver 12*a*, 12*b* is preferably provided with one or more surface indicia along at least one sidewall 16*a*, 16*b* thereof to guide the installer by indicating the location of conventional spacing intervals. More specifically, a first indicia 24 is provided at each 16 inch interval and a second indicia 26 is provided at each 24 inch interval. As should be appreciated, these indicia 24 or 26 each allow the installer to quickly determine the proper location for each stud 14*a* . . . 14*n* and thereby create the desired or proper spacing for a particular situation when forming the framing section 10. To allow the installer to distinguish between the different indicia, the first indicia 24 is preferably formed using a first symbol, such as the illustrated hatching pattern having diagonal lines slanting in a first direction, while the second indicia is formed using a second hatching pattern having diagonal lines slanting in a second direction. Alternatively, colors, stripes, marks, words, numbers, letters, or other symbols may be used, both alone or in combination with the hatching patterns. Both the indicia 28 nearest each end of the receiver 12*a* or 12*b*, and the indicia where the 16 and 24 inch intervals fall at the same location (i.e., 48 inches) may also be provided with a distinctive pattern, such as a combined cross-hatching shown in FIG. 3, to indicate to the installer the location on a particular receiver 12*a* or 12*b* where both the 16 and 24 inch intervals begin (see FIGS. 1 and 3).

An alternate embodiment of the framing system described above is shown in FIG. 6. Instead of providing pairs of vertically spaced and aligned protrusions 20*a*, 20*b*, a single protrusion 20*a* is formed in each sidewall 16*a*, 16*b* of the receivers 12*a*, 12*b* at the selected interval. Likewise, instead of a pair of apertures 22*a*, 22*b*, a correspondingly shaped single aperture 22*a* is formed in each opposed sidewall 18*a*, 18*b* at each end of the stud 14*n* for receiving each opposed protrusion 20*a* in snap-fit engagement. Although only a single protrusion 20*a* in each opposed sidewall 16*a*, 16*b* of the receiver 12*a* or 12*b* holds the stud 14*n* in place, the overall resistance against rotation in the horizontal plane is uncompromised as a result of the secure snap-fit engagement. Also, since the protrusions 20*a* still create the desired substantially continuous and unbroken outer surface with the respective sidewall 16*a*, 16*b*, removing each stud 14*a* . . . 14*n* is possible without the need for significantly bending, deforming or damaging the corresponding receiver 12*a* or 12*b*. Of course, a plurality of these single protrusions 20*a* are preferably provided in each receiver 12*a*, 12*b*, spaced along the respective sidewalls 18*a*, 18*b* in the same horizontal plane. The spacing interval may be as described above (12, 2, 16 or 24 inches), or in other increments, as required for a particular application. Of course, the first and/or second indicia 24 or 26 indicating the location of conventional intervals may also be provided in this embodiment (only indicia 24 shown in FIG. 6).

Figure 6:
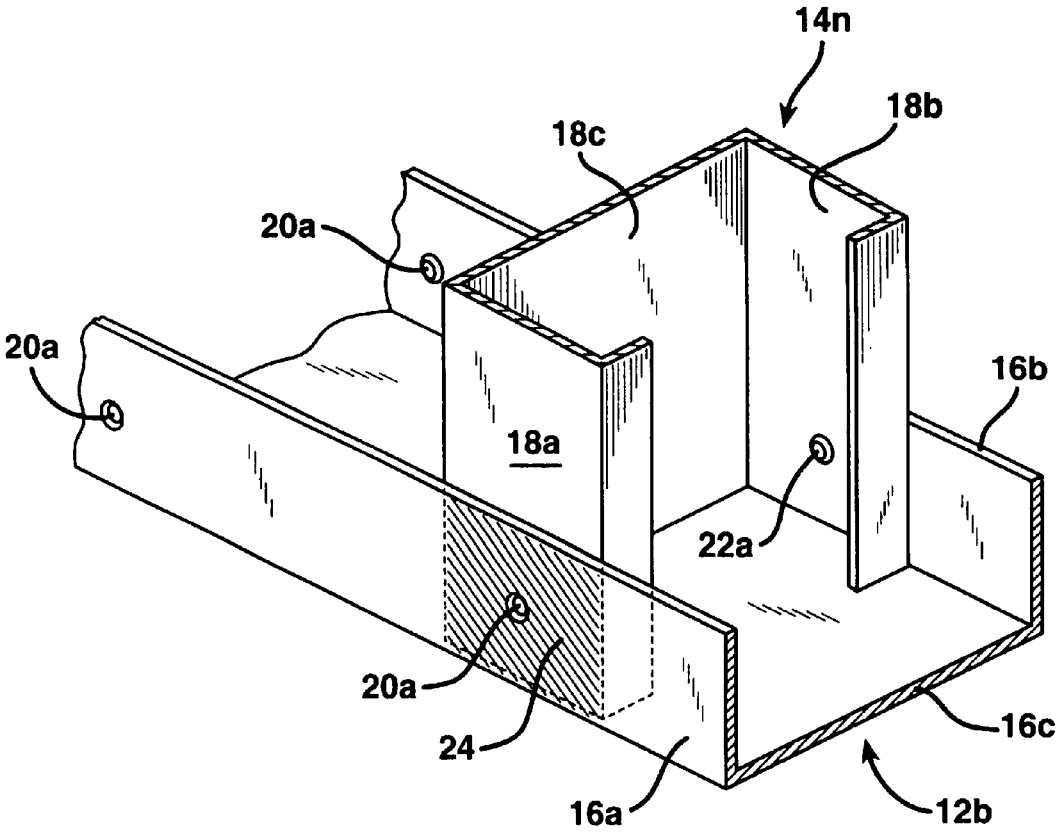
FIG. 6 is a view similar to FIG. 2 showing an alternate embodiment wherein a single row of protrusions aligned in the horizontal plane are formed in each sidewall of the receiver and a corresponding aperture is formed in each sidewall of the stud.
Figure 7:
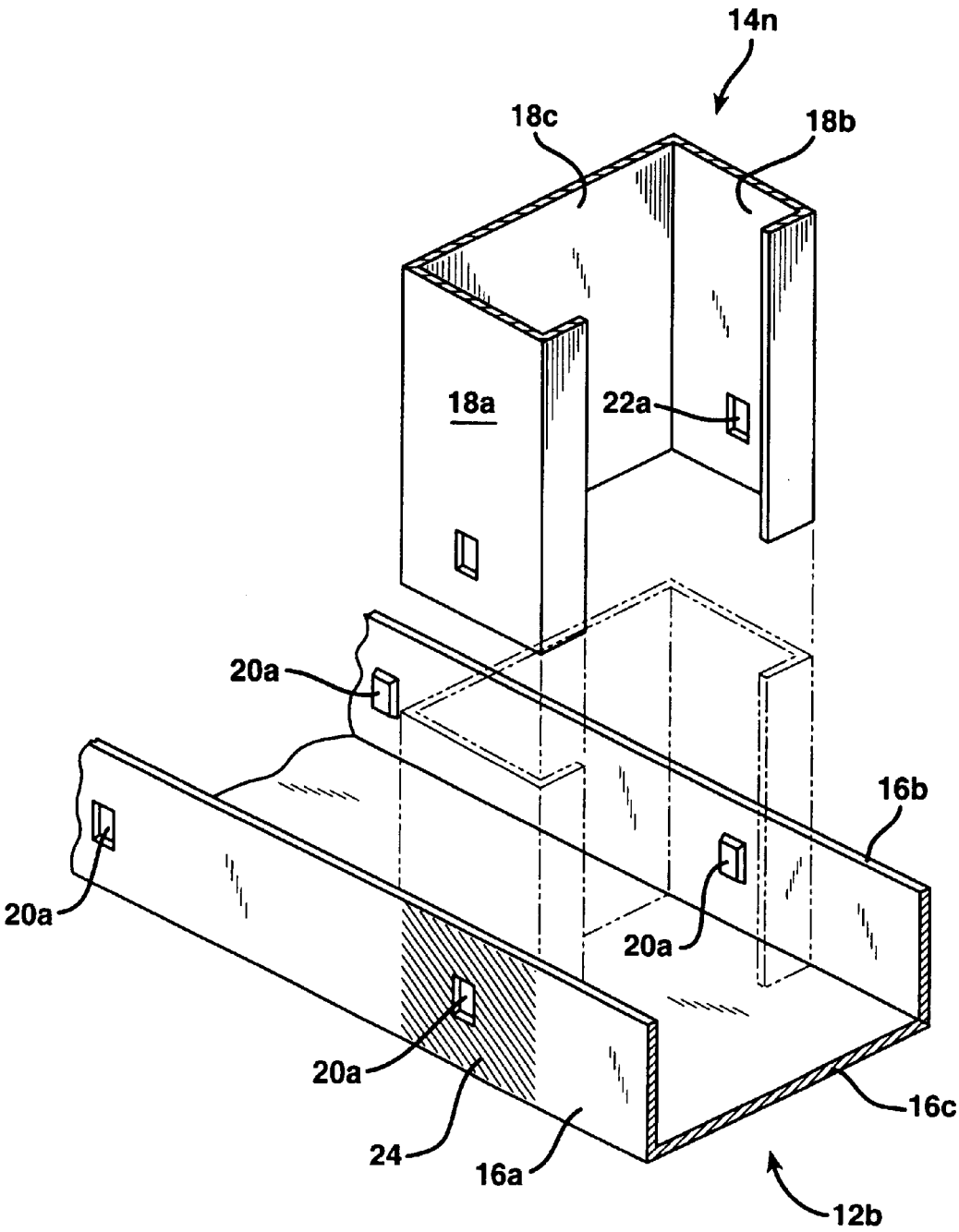
FIG. 7 is an exploded perspective view illustrating another alternate embodiment wherein a single protrusion having a rectangular cross-section is provided in each sidewall of the receiver for mating with a similarly shaped aperture in each corresponding sidewall at one end of the stud.
Figure 8:
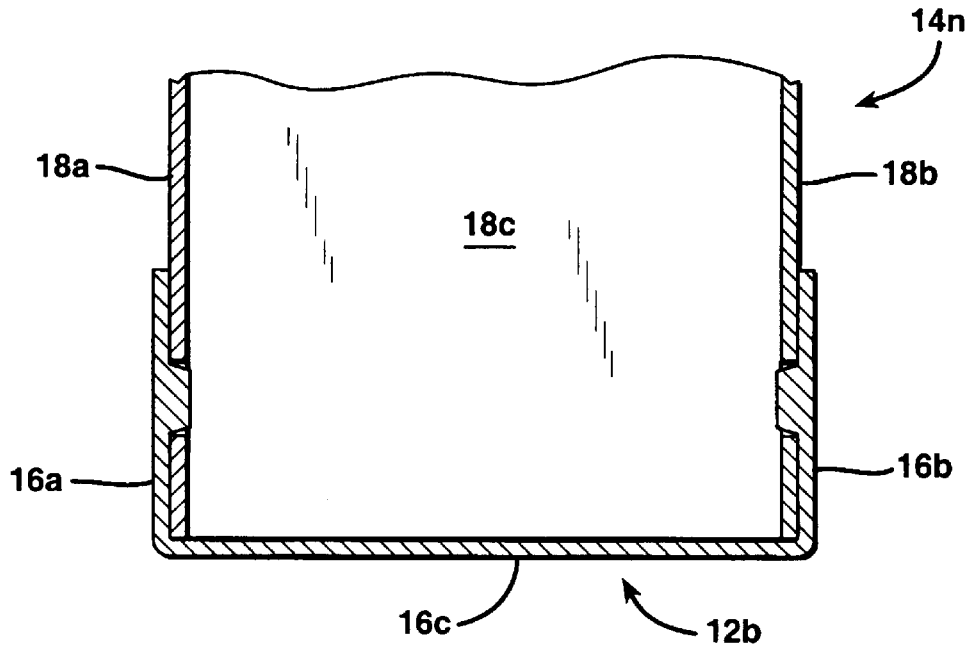
FIG. 8 is a cross-sectional view of the embodiment shown in FIG. 7, but with the stud engaged in the U-shaped receiver.

As also illustrated in FIG. 6, the single protrusion 20*a* is preferably hemispherical. However, as shown in FIGS. 7 and 8, it is also possible to provide a single protrusion 20*a* in the form of a truncated pyramid having a substantially rectangular cross-section and tapered side edges. As should be appreciated, tapering each edge facilitates the insertion of this single protrusion 20*a* in the correspondingly shaped aperture or opening 22*a* in each opposed sidewall 18*a*, 18*b* of the stud 14*n* from the top or side. It should also be appreciated that the protrusion 22*a* having a rectangular (or an equivalent square) cross-section provides equal or ever superior protection against rotation as a hemispherical protrusion or similarly shaped dimple. Moreover, when combined with the substantially continuous and unbroken outer surface, the tapered lateral and lower side face of the rectangular protrusion 20*a* also allows for the easy removal of each stud 14*n* from between the receivers 12*a* or 12*b*, if necessary, either by gently pulling upwardly on the stud or rotating it about its vertical center axis.

Figure 9:
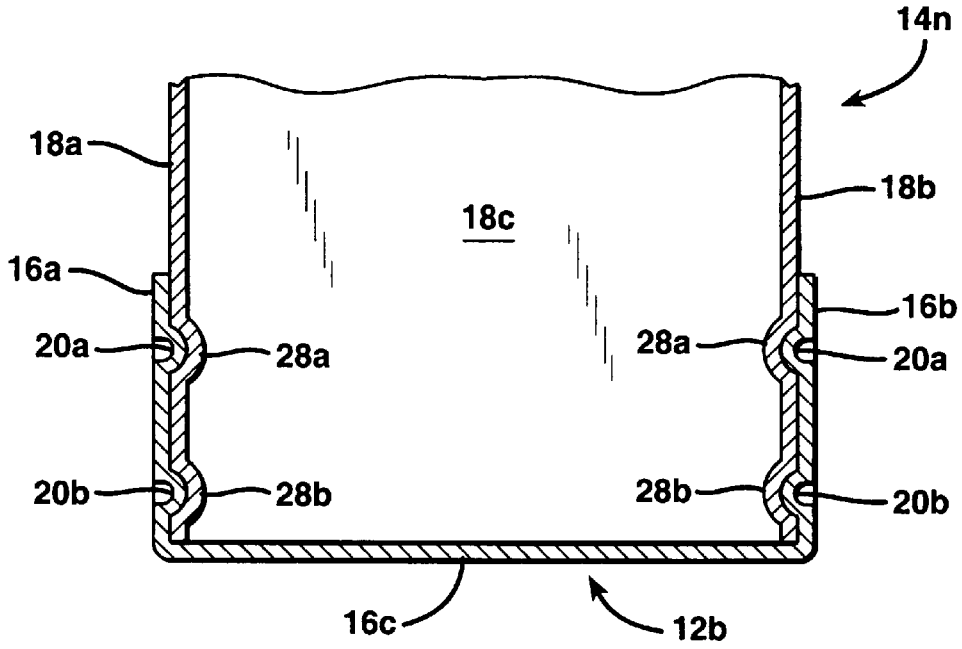
FIG. 9 is a cross-sectional view illustrating an alternate embodiment wherein the opposed sidewalls at one end of the stud include pairs of vertically spaced recesses that correspond to the similarly shaped and spaced protrusions in the sidewalls.

Yet another alternate embodiment of the framing system is shown in FIG. 9. In this embodiment, each receiver 12*a*, 12*b* includes a plurality of pairs of vertically spaced protrusions 20*a*, 20*b* as described above, but instead of apertures 22*a* or 22*b*, the stud 14*n* includes inwardly projecting recesses 28*a*, 28*b*. These recesses 28*a*, 28*b* are contoured to conform to the shape of the protrusions 20*a*, 20*b* and thereby create the desired snap-fit engagement when the corresponding end of the stud 14*n* is passed into the receiver 12*a* or 12*b*. Also, the recesses 28*a*, 28*b* have a substantially continuous and unbroken outer surface relative to the corresponding sidewall 18*a* or 18*b* of the stud 14*n*. As described above, avoiding the edges created by a broken recess of the type proposed in the prior art ensures that the stud 14*n* may be rotated in or lifted out of the corresponding receiver 12*b* with ease. This is done by simply supplying a sufficient upward or rotational force to overcome the detent-like force created by the snap-fit engagement established between the protrusions 20*a*, 20*b* and the recesses 28*a*, 28*b*. As with the other embodiments described above, the protrusions 20*a*, 20*b* are preferably hemispherical, but may also have other shapes, including a square or equivalent rectangular cross section (not shown).

Figure 10:
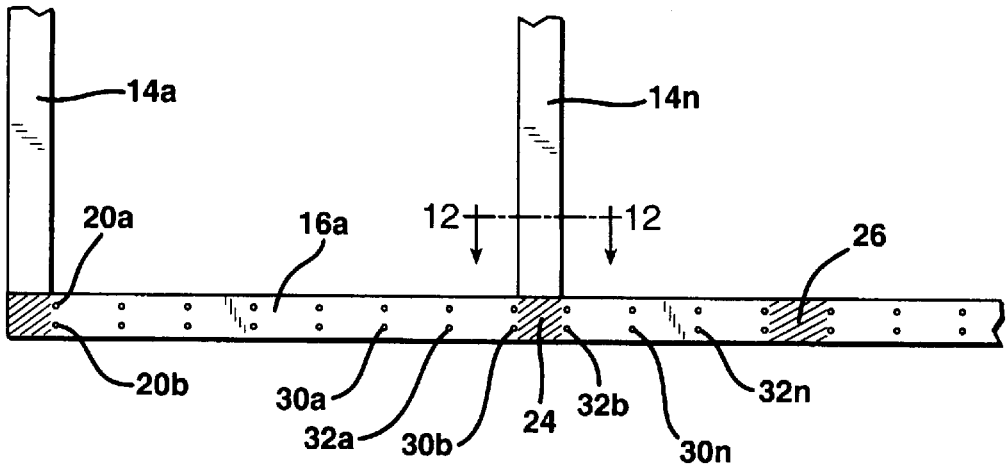
FIG. 10 is a partially cutaway side elevational view illustrating yet another embodiment wherein the opposed sidewalls of the receiver each include first and second pairs of spaced protrusions and a first end of the stud is inserted between and engaged by adjacent ones of the protrusions, and further showing the various surface indicia for marking certain spacing intervals.
Figure 11:
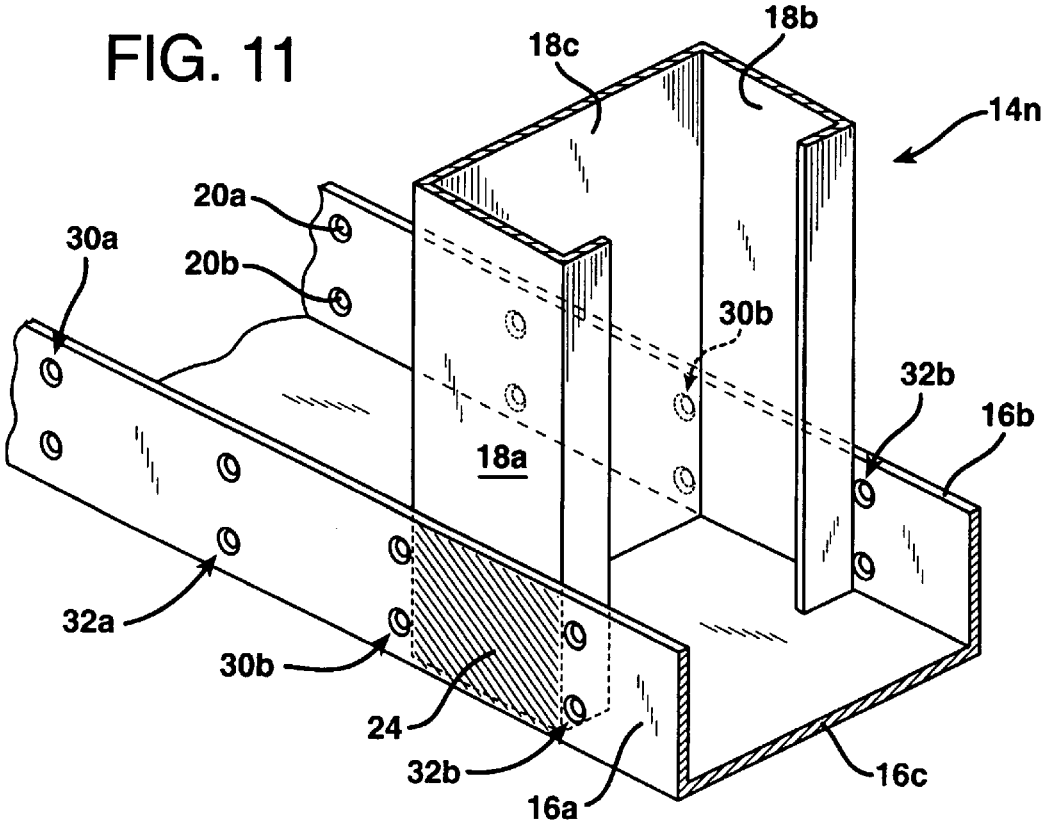
FIG. 11 is a perspective view of the embodiment shown in FIG. 10, with the stud engaged between adjacent spaced vertically aligned pairs of protrusions formed in each sidewall of the receiver.
Figure 12:
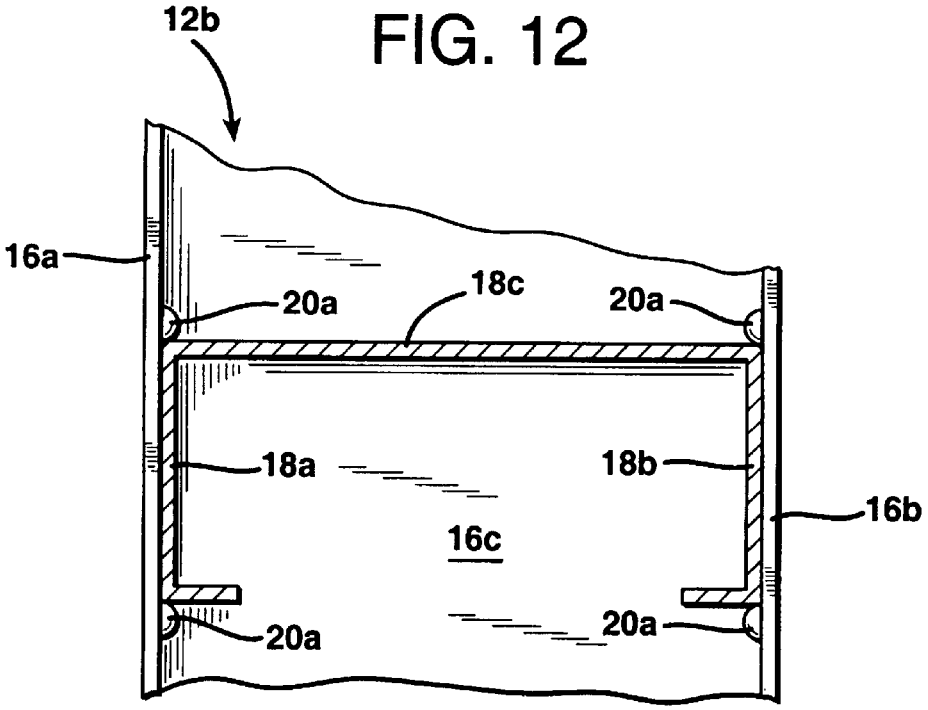
FIG. 12 is a partially cross-sectional, partially cutaway top view of a single stud in the embodiment of FIG. 10.

FIGS. 10–12 show another embodiment of the framing section 10 of the present invention wherein vertically spaced and aligned pairs of inwardly projecting protrusions 20*a*, 20*b* are formed in each receiver 12*a*, 12*b* (only receiver 12*b* shown) and arranged in successive pairs 30*a*, 32*a*; 30*b*, 32*b*; 30*n*, 32*n*. Instead of being received in corresponding apertures in the stud 14*n*, each successive pair of protrusions 20*a*, 20*b* are spaced for receiving the corresponding first or lower end of the stud 14*n* therebetween in a relatively tight, seated engagement. As shown in FIGS. 11 and 12, these protrusions 30*b*, 32*b* serve to capture and hold this first or lower end of the stud 14*n* in place and prevent it from rotating in the horizontal plane relative to the receiver 12*b*. The same arrangement is provided in the receiver 12*a* (not shown) for engaging and securely holding the opposite or second end of each stud 14*n* in place. By providing pairs of protrusions 20*a*, 20*b* for engaging the stud 14*n*, the overall stability and resistance to rotation in the horizontal plane is greatly enhanced.

As shown in FIG. 10, each corresponding pair of protrusions 30*b*, 32*b* is spaced apart such that the distance between the trailing edge of each of the first pair of protrusions 30*n* and the leading edge of the next-in-line or adjacent pair of protrusions 32*n* is substantially equal to the width of the stud 14*n*. This ensures that the stud 14*n* is mechanically held captive and able to fully resist rotation in the horizontal plane. The spacing between each successive corresponding pair of protrusions 30*n*, 32*n* is also preferably a distance equal to the width of the stud 14n, since this spacing not only permits variable positioning, but also allows for the placement of a double stud, if necessary. Alternatively, and similar to the other embodiments described above, the spacing between the successive corresponding pairs of protrusions 30*n*, 32*n* may be in relatively short, equidistant intervals, such as 12 or 2 inches, or the spacing may be at conventional intervals such as 16 or 24 inches, measured on centers. Of course, other intervals may also be used, depending on the particular application. As also described above, conventional spacing intervals for the studs 14*n* . . . 14*a*, such as 16 and 24 inches, may be marked by placing indicia, such as the first and second indicia 24, 26 shown in FIG. 10, on the receiver 12*a*, 12*b* between or otherwise adjacent to the protrusions 30*n*, 32*n*.

Figure 13:
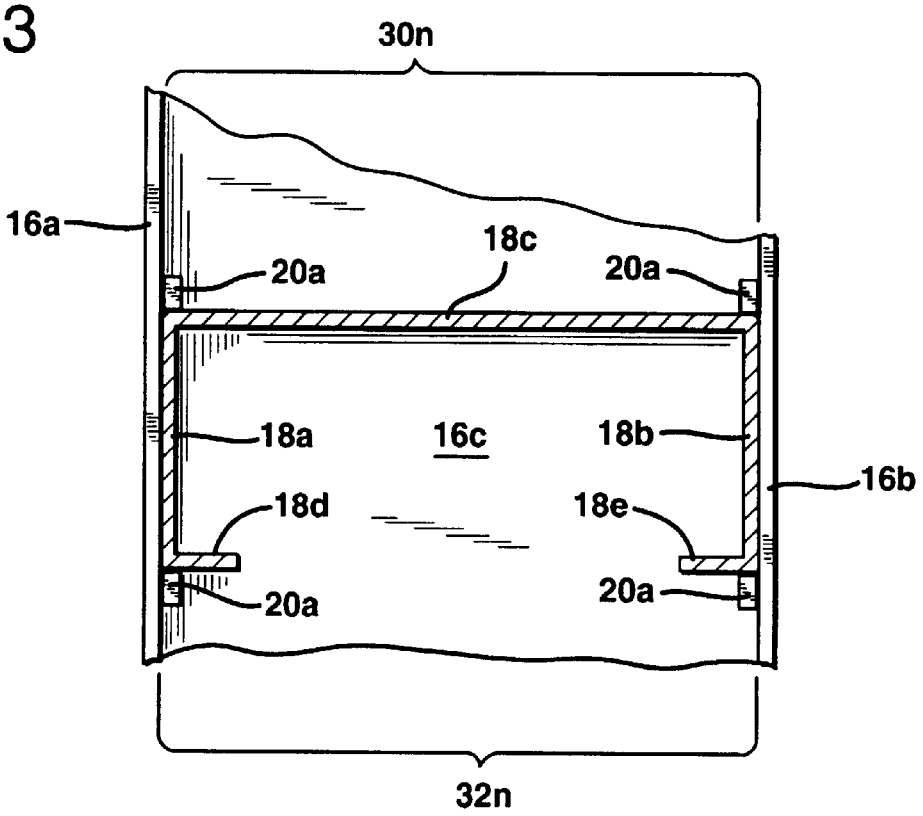
FIG. 13 is a partially cross-sectional, partially cutaway top plan view similar to the embodiment of FIG. 10, but wherein the protrusions have a rectangular cross-section.

An alternative to the embodiment shown in FIGS. 10–12 is illustrated in the partially cutaway top plan view of FIG. 13. Instead of being hemispherical in shape, the pairs of vertically spaced protrusions 20*a*, 20*b* are provided with a rectangular cross-section and substantially parallel top and side walls (only the upper protrusions 20*a* are shown in the top plan view of FIG. 13). Thus, the pairs of spaced protrusions 30*n*, 32*n* closely interfit with and engage the smooth, parallel sidewall 18*c* of the stud 14*n* and the ends of the sidewalls 18*a*, 18*b*, or the smooth, parallel outside of the inwardly projecting lips 18*d*, 18*e*, whichever is present.

Although not specifically illustrated, it should be appreciated that the end of each receiver 12*a*, 12*b* may include an orthogonal end wall (not shown) interconnecting the sidewalls 16*a*, 16*b* and the transverse connecting wall 16*c*. Thus, in the embodiments shown in FIGS. 10–13, if a stud 14*n* is placed in position of stud 14*a* of FIG. 10, or in the same position at the opposite end of the receiver 12*a* or 12*b*, the leading surfaces, such as the outer surfaces of the flanges 18*d*, 18*e*, are engaged by only a single pair of protrusions projecting from each sidewall 16*a* or 16*b*, with the trailing surfaces of the stud 14*a*, such as the outer surface of the transverse wall 18*c*, engaging the adjacent end wall.

In a most preferred form of each embodiment described above, the studs 14*a* . . . 14*n* and receivers 12*a*, 12*b* are both formed of galvanized steel, but it should be appreciated that fabricating these members from other metals, plastics, composites or similar materials is also possible. The type and gauge of material used will usually depend on the particular application (i.e., a residential dwelling or office building), as well as the wind and weather conditions in the area. The protrusions 20*a* or 20*b* may be formed using a manually operable stamping tool having interchangeable dies of a type known in the art, while the apertures 22*a*, 22*b* may be formed using a drill or punch.

The dimensions of the studs 14*a* . . . 14*n* and receivers 12*a*, 12*b*, as well as the size and spacing of the protrusions 20*a* or 20*b* and apertures/recesses 22*a* or 22*b*, may vary widely depending on the particular application. By way of example only, for a receiver 12*a* or 12*b* made of 20 gauge steel having 2 inch high sidewalls 16*a*, 16*b* and a 3 ⅝ inch wide connecting wall or web 16*c*, each protrusion 20*a* or 20*b* is approximately one quarter inch in diameter as measured from the base, approximately one eighth of an inch deep, and in cases where vertically spaced pairs of protrusions 20*a*, 20*b* are provided, approximately seven-eighths of an inch apart in the vertical plane. The corresponding apertures 22*a*, 22*b*, of course, have substantially the same diameter and are spaced and positioned so as to align with or engage the protrusion(s) 20*a* or 20*b* when the terminal end of the stud 14*n* is seated in the corresponding receiver 12*a*, 12*b*. The length of the transverse connecting wall 18*c* of each stud 14*n* is approximately 32 inches (the thickness of the sidewalls 16*a* and 16*b* make up the remaining ⅛th inch), and the width of the sidewalls 18*a* and 18*b* depends entirely on the particular application. Of course, the relative spacing of the protrusions 20*a* or pairs of protrusions 20*a*, 20*b*; 30*n*, 32*n* along the sidewalls 16*a*, 16*b* is chosen based upon the width of the sidewalls 18*a*, 18*b*, or visa versa.

The foregoing description of the preferred and various alternative embodiments of the present invention have been presented for purposes of illustration and description. The description is not intended to be exhaustive or to limit the invention to the precise form disclosed. Obvious modifications or variations are possible in light of the above teachings. For instance, in any of the embodiments described herein, the protrusions 20*a* or pairs of protrusions 20*a*, 20*b*; 30*n*, 32*n* may be formed in the stud 14*n* and the corresponding apertures or openings 22*a* or 22*b* formed in the receiver 12*a* or 12*b*. Also, although hemispherical or rectangular protrusions are preferred, other shapes may be used without departing from the broadest aspects of the present invention. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A framing system, comprising:

at least one first framing member having at least one first protrusion formed in a first sidewall thereof and at least one second protrusion formed in a second sidewall thereof, each of said protrusions having a substantially continuous and unbroken outer surface relative to each of said sidewalls, wherein said at least one first framing member comprises a first substantially U-shaped receiver, said receiver including a plurality of vertically aligned and spaced pairs of protrustions projecting from each opposed sidewall thereof;

at least one second framing member having at least one first aperture formed in a first sidewall thereof for receiving the corresponding first protrusion in a snap-fit engagement and at least one second aperture formed in a second sidewall thereof for receiving the second protrusion, also in a snap-fit engagement, wherein said at least one second framing member comprises a stud, wherein said first and second apertures are formed at a first end of said stud corresponding to said first U-shaped receiver and the first and second sidewalls of both said receiver and said stud are opposed;

a second U-shaped receiver, each said receiver including a plurality of vertically aligned and spaced pairs of protrusions projecting from each opposed sidewall thereof; and a plurality of said studs, each further including first and second pairs of vertically aligned and spaced apertures formed in the opposed sidewalls at each end thereof for receiving the corresponding pairs of protrusions in each of said first and second receivers in a snap-fit engagement.

2. The framing system according to claim 1, wherein each of said first protrusions is separated from an adjacent one of said first protrusions by an interval of 2 inches and each of said second protrusions is separated from an adjacent one of said second protrusions by an interval of 2 inches.

3. The framing system according to claim 1, wherein each of said first protrusions is separated from an adjacent one of said first protrusions by an interval of 16 inches and each of said second protrusions is separated from an adjacent one of said second protrusions by an interval of 16 inches.

4. The framing system according to claim 1, wherein said protrusions on each said sidewall of said second U-shaped receiver are spaced apart and substantially aligned in a horizontal plane.

5. The framing system according to claim 4, wherein each of said first protrusions is separated from an adjacent one of said first protrusions by an interval of 12 inches and each of said second protrusions is separated from an adjacent one of said second protrustions by an interval of 12 inches.

6. The framing system according to claim 4, wherein each of said first protrusions is separated from an adjacent one of said first protrusions by an interval of 24 inches and each of said second protrusions is separated from an adjacent one of said second protrusions by an interval of 24 inches.

7. The framing system according to claim 6, wherein a second surface indicia is provided on each first and second receiver adjacent to at least one of said first or second protrustions at each twenty-four inch interval.

8. The framing system according to claim 1, wherein each of said first protrusions is separated from an adjacent one of said first protrusions by an interval of 24 inches and each of said second protrusions is separated from an adjacent one of said second protrusions by an interval of 24 inches.

9. The framing system according to claim 1, wherein each of said first protrusions is separated from an adjacent one of said first protrusions by an interval of 12 inches and each of said second protrusions is separated from an adjacent one of said second protrusions by an interval of 12 inches.

10. The framing system according to claim 3, wherein a first surface indicia is provided on each said first and second receiver adjacent to the protrusions in at least one of said sidewalls.

11. The framing system according to claim 8, wherein a second surface indicia is provided on each said receiver adjacent to the protrusions in at least one of said sidewalls.

12. The framing system according to claim 1, wherein said protrusions are substantially hemispherical.

13. The framing system according to claim 1, wherein said protrusions are substantially rectangular in cross-section.

14. The framing system according to claim 4, wherein each of said first protrusions is separated from an adjacent one of said first protrusions by an interval of 2 inches and each of said second protrusions is separated from an adjacent one of said second protrusions by an interval of 2 inches.

15. The framing system according to claim 4, wherein each of said first protrusions is separated from an adjacent one of said first protrusions by an interval of 16 inches and each of said second protrusions is separated from an adjacent one of said second protrusions by an interval of 16 inches.

16. The framing system according to claim 15, wherein a first surface indicia is provided on each said first and second receiver adjacent to at least one of said first or second protrusions at each sixteen inch interval.

17. A framing system, comprising:

a first framing member having at least one first protrusion formed in a first sidewall thereof and at least one second protrusion formed in a second sidewall thereof, wherein said first framing member comprises a U-shaped receiver;

at least one second framing member having at least one first sidewall thereof for receiving the corresponding first protrusion in a snap-fit engagement and at least one second shaped recess formed in a second sidewall thereof for receiving the second protrusion also in a snap-fit engagement, each of said recesses having a substantially continuous and unbroken outer surface relative to each of said sidewalls, wherein said at least one second framing member comprises a stud, wherein said first and second recesses are formed at a first end of said stud corresponding to said first U-shaped receiver;

a second U-shaped receiver, each of said first and second receivers including a plurality of vertically aligned pairs of spaced protrusions projecting from each sidewall thereof; and a plurality of studs, each including first and second pairs of corresponding shaped recesses formed in each end thereof for receiving one of the corresponding pairs of protrusions in said receivers in a snap-fit engagement to form a framing section.

* * * * *